United States Patent [19]

Cochrane

[11] Patent Number: 5,016,364

[45] Date of Patent: May 21, 1991

[54] SHOE DRYER

[76] Inventor: Russell D. Cochrane, Rte. 1, Box 247-C, Highlands, N.C. 28741

[21] Appl. No.: 512,324

[22] Filed: Apr. 23, 1990

[51] Int. Cl.[5] ..... F26B 19/00

[52] U.S. Cl. ..... 34/202; 34/195

[58] Field of Search ..... 34/195, 196, 197, 219, 34/224, 225, 231, 48, 50, 233, 202

[56] References Cited

U.S. PATENT DOCUMENTS

| | | | |
|---|---|---|---|
| 11,460 | 12/1894 | Proctor | 34/196 |
| 4,358,899 | 11/1982 | Murch et al. | 34/233 |
| 4,625,432 | 12/1986 | Baltes | 34/196 |
| 4,772,439 | 9/1988 | Trevino-Gonzalez | 34/219 |
| 4,908,959 | 3/1990 | Kretchman et al. | 34/104 |
| 4,918,290 | 4/1990 | DeMars | 34/233 |

FOREIGN PATENT DOCUMENTS

| | | | |
|---|---|---|---|
| 109663 | 8/1979 | Japan | 34/195 |
| 1068298 | 3/1989 | Japan | 34/202 |

*Primary Examiner*—Henry A. Bennet
*Assistant Examiner*—Denise L. F. Gromada
*Attorney, Agent, or Firm*—Don J. Flickinger; Jordan M. Meschkow

[57] ABSTRACT

A drying apparatus which utilizes air circulation to uniformly dry articles is disclosed. The apparatus includes an enclosure having racks upon which the articles to be dried are placed. An air exchanger couples to the enclosure to recirculate and heat air within the enclosure. Recirculation operates continuously while articles are being dried, and recirculation air temperature is maintained around a predetermined level through a thermostat coupled to heating elements. The air exchanger is configured so that air expelled from the air exchanger travels upward near the enclosure's walls, then downward in the center of the enclosure back to the air exchanger. An exhaust fan is controlled by a humidistat to remove humid air from the enclosure whenever the humidity within the enclosure exceeds a predetermined level. Consequently, a mean humidity level is maintained within the enclosure to prevent excessive drying, and substantial recirculation of air results in improved efficiency.

18 Claims, 1 Drawing Sheet

SHOE DRYER

TECHNICAL FIELD OF THE INVENTION

The present invention relates generally to dryers. More specifically, the present invention relates to dryers which use forced air to accomplish drying, and to dryers which are adapted to dry articles, such as shoes, that would be damaged if exposed to significant heat or if caused to collide with each other or with the dryer itself.

BACKGROUND OF THE INVENTION

When participating in outdoors activities and on numerous other occasions, a person's shoes may get wet. Generally speaking, wet shoes are not desirable. Such wet shoes are uncomfortable for the wearer and may lead to shoe shrinkage, foot blisters, and other problems. In addition, shoes are often made, at least in part, from leather which becomes damaged and unattractive if exposed to excessive moisture for extended periods of time. Furthermore, the specialty shoes worn by outdoors enthusiasts, such as athletic shoes, golf shoes, boots, and the like, are expensive. Thus, persons having wet shoes generally want such shoes dried so that the shoes will be available for future activities and will remain in a good and attractive condition for as long as possible.

Wet shoes may be left to dry on their own. However, this often provides an undesirable solution to the problem of wet shoes because the shoes tend to dry too slowly. In other words, with this shoe-drying technique, shoes are often still wet when they are next worn. Additionally, if the shoes tend to get wet often, they soon experience leather damage and become unattractive. While this shoe-drying technique might be acceptable in dryer climates, it clearly fails to provide an acceptable solution in wetter climates. Consequently a need exists for an apparatus which aids in the drying of shoes and like articles.

Various forms of dryers are potentially available for use in drying shoes. However, such conventional dryers do not adequately serve the drying needs of shoes and like articles. For example, conventional clothes dryers often operate at high temperatures which may damage leather, rubber, and plastic portions of shoes. Furthermore, such dryers generally fail to protect against excessive dryness for each article within the dryers. In addition, such conventional dryers use a rotating barrel or tub within which articles are placed for drying. The rotation of this barrel causes collisions between the articles being dried therein and with the barrel itself. While such rotation advantageously mixes the articles so that they dry uniformly and expeditiously, it is not acceptable for shoes and like articles. Such articles would become damaged by the collisions. This damage would be ruinous in the case of golf and other sporting shoes that have cleats.

Alternatively, ovens may serve as dryers. Generally speaking, an oven merely heats the interior space of the oven and does not impart motion to the oven's contents. While the mere heating of an oven's interior may have a drying effect on the oven's contents, this type of drying is not acceptable for use in connection with shoes and like articles. Either the oven's heat must be raised to excessive levels in order to accomplish drying in an acceptable time frame, or an excessive period of time is consumed in order to accomplish drying while maintaining the articles at an acceptably low temperature. Furthermore, conventional ovens fail to protect against excessive dryness and fail to dry articles uniformly.

SUMMARY OF THE INVENTION

Accordingly, it is an advantage of the present invention that an improved apparatus which is adapted to the drying of shoes and like articles is provided.

Another advantage of the present invention is that the present invention uses forced air in connection with mild heat within a humidity-controlled enclosure to dry shoes and like articles.

Yet another advantage is that the present invention controls the circulation of air within an enclosure to uniformly dry articles within the enclosure.

Still another advantage is that the present invention recirculates warm, not dry air within an enclosure until humidity rises above a predetermined level.

Another advantage is that, for the most part, the present invention exhausts only humid air.

Yet another advantage is that the present invention provides a relatively efficient drying apparatus.

The above and other advantages of the present invention are carried out in one form by a drying apparatus which protects articles from damage while they are being dried. The apparatus includes enclosure walls which surround a drying space. The walls include an exhaust port. An air exchanger couples to the enclosure walls. The air exchanger includes a circulation chamber in which both the chamber's inlet and outlet are in pneumatic communication with the drying space. In addition, the chamber's inlet is located near the exhaust port. A first air propelling device couples to the circulation chamber to move air through the chamber. In addition, the apparatus includes a heater which couples to one of the air exchanger and the enclosure walls. A second air propelling device couples to the enclosure walls within the exhaust port to selectively urge air out from the drying space.

The above and other advantages of the present invention are carried out in another form by a method of drying shoes and like articles. With the method of the present invention, shoes are held at a stationary position within an enclosure. Air is continually propelled within the enclosure around the shoes until the shoes are substantially dry. The propelled air is maintained at a predetermined temperature, which is greater than the ambient temperature outside the chamber. Moreover, a substantial portion of the propelled air is recirculated so long as the humidity of the air remains below a predetermined level. However, when the humidity of the air exceeds the predetermined level, the substantial portion of the propelled air is exhausted out from the enclosure.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENT

Figure 1:
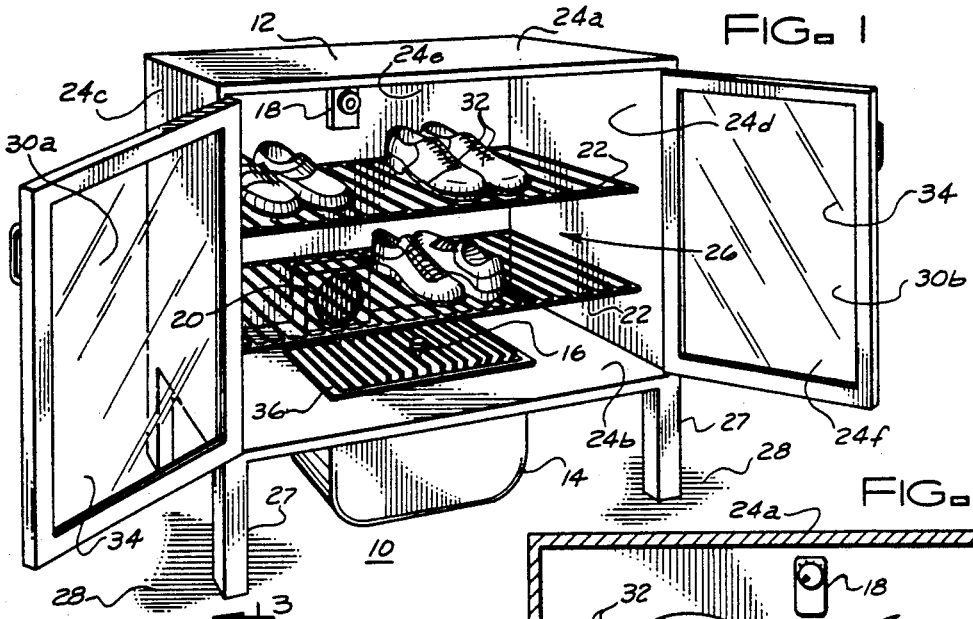
FIG. 1 shows a front, perspective view of a dryer constructed in accordance with the principles of the present invention.

FIG. 1 shows an exemplary dryer 10 constructed in accordance with the teaching of the present invention. The dryer 10 illustrated in FIG. 1 is suitable for use by country clubs, schools, and like organizations that are faced with the problem of simultaneously drying several pairs of wet shoes. In the preferred embodiment, dryer 10 includes an enclosure or cabinet 12, an air exchanger 14, a thermostat 16, a humidistat 18, an exhaust unit 20, and shoe racks 22.

Enclosure 12 includes enclosure walls 24, which surround a drying space 26, and legs 27. Legs 27 space walls 24 above a floor 28 to permit sufficient space underneath walls 24 for air exchanger 14 and to ease access to drying space 26. Of course, those skilled in the art will recognize that a pedestal (not shown) may be substituted for legs 27. Enclosure walls 24 include an upper wall **24*a*, a lower wall 24*b*, left and right side walls 24*c* and 24*d*, respectively, a back wall 24*e*, and a front wall 24*f*. In the preferred embodiment, walls 24 are configured so that drying space 26 forms a solid, rectangular shape measuring approximately 48 inches wide, 36 inches high, and 24 inches deep. Since the maximum heat utilized in connection with the present invention is significantly less than the temperatures encountered in conventional clothes dryers or ovens, walls 24** may be formed from wood using conventional cabinet-making techniques.

Front wall **24*f* includes left and right doors 30*a* and 30*b*, respectively. Left door 30*a* is hinged to left side wall 24*c*, and right door 30*b* is hinged to right side wall 24*d*. Doors 30*a*–30*b* may be opened to gain access to drying space 26 and closed to enclose articles, such as shoes 32, in drying space 26. In the preferred embodiment, doors 30*a*–30*b* each include a transparent sheet insert 34 formed from a material such as glass or more preferably PLEXIGLAS. Insert 34 allows a person to observe the contents of dryer 10 without opening doors 30*a*–30*b***.

Shoe racks 22 span the entire width and depth of drying space 26 within enclosure 12. In addition, racks 22 are vertically spaced apart from one another and from upper and lower walls **24*a* and 24*b*, respectively. Each of racks 22 exhibits sufficient strength to support several pairs of shoes 32, and is readily permeable to the flow of air. In the preferred embodiment, each of racks 22 resembles a frame of small bars. At least two of these bars span the width of enclosure 12 near front wall 24*f* and near back wall 24*e*, respectively. Additional bars are spaced about one inch apart and span the depth of enclosure 12 between the above-discussed two bars. While the figures illustrate the use of two of racks 22, those skilled in the art will understand that any number of racks 22 may be included within enclosure 12**.

Figure 2:
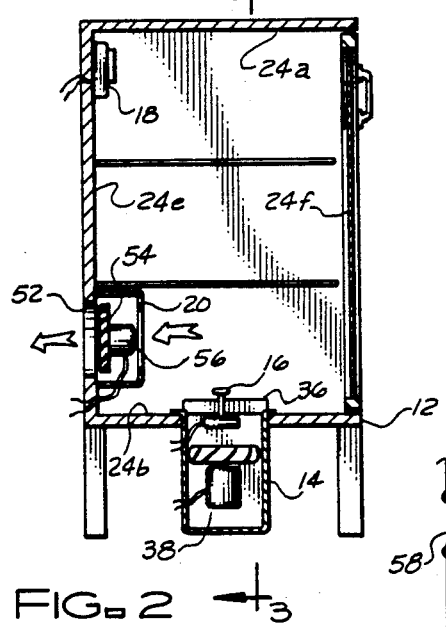
FIG. 2 shows a cross-sectional side view of the dryer of the present invention.
Figure 3:
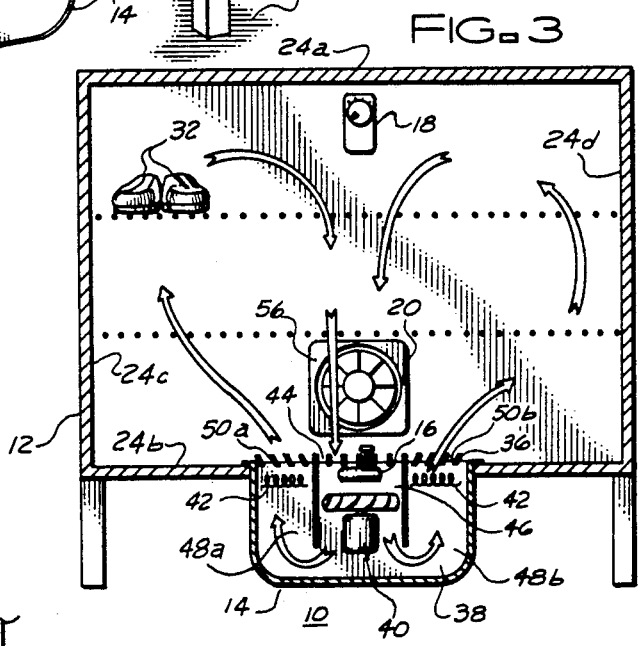
FIG. 3 shows a cross-sectional side view of the dryer of the present invention taken about line 3—3 of FIG. 2.

FIGS. 2 and 3 show cross-sectional side views of dryer 10 that illustrate the structure of air exchanger 14, which operates to recirculate air within drying space 26. Specifically, air exchanger 14 is centrally located on lower wall **24*b*. Air exchanger 14 includes a grate 36 which faces upward into drying space 26 from lower wall 24*b*. Beneath lower wall 24*b*, air exchanger 14 includes a circulation chamber 38, a motorized recirculation fan or blower 40, and heating elements 42. In addition, thermostat 16 is located in air exchanger 14** in the preferred embodiment.

Grate 36 is configured to direct air flow in diverse directions, and grate 36 mates with circulation chamber 38 so that air is injected into air exchanger 14 from one direction and expelled from air exchanger 14 in other directions. Specifically, an inlet baffle portion 44 of grate 36, which is located in the center of grate 36, directs air substantially vertically downward from drying space 26 into an inlet 46 of circulation chamber 38. In other words, inlet baffle 44 is configured to direct air flow in a direction which has little or no horizontal component.

In the preferred embodiment thermostat 16 mounts to grate 36 in inlet 46, and recirculation fan 40 mounts beneath thermostat 16 within inlet 46. At the exhaust side of recirculation fan 40, circulation chamber 38 forms left and right outlets **48*a* and 48*b*, respectively. In other words, circulation chamber 38 includes a "T" junction beneath recirculation fan 40, and recirculation fan 40 propels air in both left and right directions when viewing dryer 10 from the front. Preferably, approximately equal air flow rates travel in both directions. Heating elements 42 are located in each of outlets 48*a*–48*b*. Heating elements 42 are controlled by thermostat 16, as discussed below in connection with FIG. 4. Outlets 48*a*–48*b* terminate at left and right outlet baffle portions 50*a* and 50*b*, respectively, of grate 36**.

Outlet baffle **50*a* is located on the end section of grate 36 which resides to the left of inlet baffle 44, viewing dryer 10 from the front, and outlet baffle 50*b* is located on the end section of grate 36 which resides to the right of inlet baffle 44. Unlike inlet baffle 44, each of outlet baffles 50*a*–50*b* is configured to direct air flow in a direction which has a substantial horizontal component. Specifically, outlet baffle 50*a* directs air flow to the left and upwards while outlet baffle 50*b*** directs air flow to the right and upwards.

Due to the operation of air exchanger 14, air within drying space 26 travels upward generally along the outside of space 26 near enclosure walls **24*c* and 24*d*, then downward in the center of space 26, as illustrated by arrows in FIG. 3. This circulation pattern provides for complete circulation within drying space 26. By complete circulation, those skilled in the art will understand that no dead zones, or spaces where air fails to circulate, are to be found in the vicinity of shoe racks 22, upon which shoes 32 rest for drying. As a result, dryer 10 dries each of a multiplicity of articles, such as shoes 32**, uniformly.

The cross-sectional side views of FIGS. 2 and 3 also illustrate the structure of exhaust unit 20, which operates to exhaust air out from drying space 26. Specifically, exhaust unit 20 is centrally located on back wall **24*e* near lower wall 24*b*. Exhaust unit 20 includes a hole 52 formed in wall 24*e*. An outlet of exhaust chamber 54 mates with hole 52, and a motorized exhaust fan or blower 56 mounts within exhaust chamber 54 so that when activated, exhaust fan 56 propels air within drying space 26 out of dryer 10. An inlet of exhaust chamber 54 projects within drying space 26 so that it resides near inlet baffle 44 of grate 36. The energization of exhaust fan 56 is controlled by humidistat 18, as discussed below in connection with FIG. 4. In the preferred embodiment, humidistat 18 is centrally located on back wall 24*e* near upper wall 24*a***.

Figure 4:
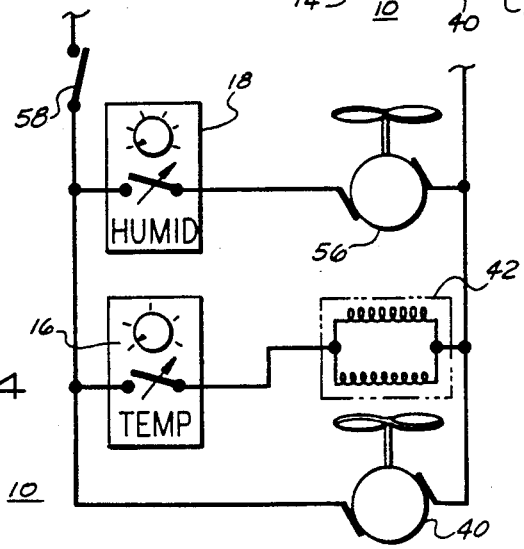
FIG. 4 shows an electrical schematic diagram of the dryer of the present invention.

FIG. 4 shows a schematic diagram of electrical connections used in the preferred embodiment of dryer 10. Conventional 110 volt public AC power energizes dryer 10. A first leg of this power couples to a first node of an operational switch 58. Although not shown in FIGS. 1-3, switch 58 may be located at any convenient place on dryer 10. A second node of switch 58 couples to a first switched contact of humidistat 18, to a first switched contact of thermostat 16, and to a first node of the motor of recirculation fan 40. A second switched contact of humidistat 18 couples to a first node of the motor of exhaust fan 56, and a second switched contact of thermostat 16 couples to a first node of heating elements 42. A second leg of the AC power couples to a second node of exhaust fan 56, a second node of heating elements 42, and a second node of recirculation fan 40.

Dryer 10 operates whenever switch 58 is closed. When switch 58 closes, recirculation fan operates, causing air within drying space 26 to circulate as discussed above in connection with FIG. 3. The mere circulation of air has a beneficial effect on uniformly drying shoes 32 or like articles. However, dryer 10 controls the temperature of this circulating air to speed the drying. Specifically, thermostat 16 is set to a desirable temperature for drying shoes 32, and thermostat 16 activates and deactivates heating elements 42 to maintain this desirable temperature.

Preferably, thermostat 16 is adjustable so that it may be set to a desired setting. Generally speaking, a small increase in air temperature over the ambient temperature outside of dryer 10 is preferred. Heating is desirable because it lowers the air's relative humidity, which allows the air to absorb more moisture. Consequently, shoes 32 or like articles dry faster. On the other hand, excessive heat is undesirable because it tends to harm shoes 32. Accordingly, thermostat 16 may be adjusted so that an optimum temperature, which allows for rapid drying without risking harm to shoes 32, is achieved.

Humidistat 18 and exhaust fan 56 operate independently from heating elements 42 or recirculation fan 40. Specifically, humidistat 18 controls the operation of exhaust fan 56 so that drying space 26 maintains at least a minimum level of humidity which is below a maximum humidity level. In other words, humidistat 18 and exhaust fan 56 are configured to exhaust air from drying space 26 when the humidity detected at humidistat 18 exceeds the maximum level. When exhaust fan 56 activates, the humid air, which now has little capacity to absorb additional moisture, is replaced by outside air. The outside air may enter through cracks in enclosure 12, or through holes (not shown) specifically provided in enclosure 12 or air exchanger 14 for that purpose. Like thermostat 16, humidistat 18 is preferably adjustable so that an optimum maximum humidity level may be established for each dryer 10.

As a result of the above-described features of dryer 10, shoes 32 or like items dry quickly and efficiently. Dryer 10 may uniformly dry several pairs of shoes 32 in a few hours without risking damage to shoes 32. Moreover, the control of exhaust fan 56 in accordance with the humidity of drying space 26 maintains some humidity within drying space 26. Consequently, shoes 32 are not excessively dried. Moreover, the control of humidity as discussed above allows for substantial recirculation of air rather than a constant influx of outside air. The substantial recirculation of air permits the use of smaller heating elements 42 and less activation time of heating elements 42 than would otherwise be required. As a result energy is conserved, and dryer 10 is inexpensive to operate.

In summary, the present invention provides an improved apparatus for drying shoes and like articles. The articles are maintained in a stationary position and not caused to collide with one another or with dryer walls. Additionally, the articles continually experience some humidity and are prevented from becoming dangerously dry. Rather, drying and uniformity of drying are substantially accomplished through the management of air circulation within the dryer. In addition, mild heat is applied and humidity is controlled to quickly and efficiently dry the articles. Humidity control permits the use of recirculated air, which improves efficiency in addition to protecting against excessive drying.

The present invention has been described above with reference to a preferred embodiment. However, those skilled in the art will recognize that changes and modifications may be made in this preferred embodiment without departing from the scope of the present invention. For example, the dryer of the present invention need not be a stand-alone cabinet but may advantageously serve as a built-in fixture. In addition, the materials discussed above may be altered to suit various application needs, and the enclosure walls may be insulated to further enhance the efficiency of the present invention. Of course, those skilled in the art will recognize that while the dryer of the present invention achieves desirable results in connection with the drying of shoes, the dryer of the present invention may be used to dry other articles. These and other changes and modifications which are obvious to those skilled in the art are intended to be included within the scope of the present invention.

What is claimed is:

1. An apparatus for drying articles and for protecting said articles from damage, said apparatus comprising:

enclosure walls completely surrounding a drying space, said drying space being configured to hold said articles, and said enclosure walls being configured to include an exhaust port therein;

an air exchanger coupled to said enclosure walls proximate a bottom portion of said drying space, said air exchanger including:

a circulation chamber having an inlet located proximate said exhaust port and having an outlet, both of said chamber inlet and outlet being in pneumatic communication with said drying space, and first air propelling means coupled to said circulation chamber to move air through said circulation chamber;

a grate having an inlet baffle portion positioned above said circulation chamber inlet and an outlet baffle portion positioned above said circulation chamber outlet;

a heater, coupled to one of said air exchanger and said enclosure walls; and second air propelling means coupled to said enclosure walls within said exhaust port, said second air propelling means being for selectively urging air out from said drying space.

2. An apparatus as claimed in claim 1 additionally comprising humidity sensing means coupled to said second air propelling means, said humidity sensing means being configured to activate said second air propelling means when humidity within said drying space exceeds a predetermined level.

3. An apparatus as claimed in claim 1 wherein said inlet baffle portion of said grate is configured to direct air flow in a first direction, said outlet baffle portion of said grate is configured to direct air flow in a second direction, and said first and second directions differ from one another.

4. An apparatus as claimed in claim 3 wherein:

said grate has first and second opposing end sections separated by a central section;

said first and second end sections collectively serve as said outlet baffle portion of said grate;

said central section serves as said inlet baffle portion of said grate; and said first, second, and central sections are cooperatively configured relative to said enclosure walls so that air tends to travel upward out from said grate along a path which resides near said enclosure walls and downward into said grate along a path which resides in a central portion of said drying space.

5. An apparatus as claimed in claim 4 additionally comprising humidity sensing means coupled to said second air propelling means, said humidity sensing means being configured to activate said second air propelling means when humidity within said drying space exceeds a predetermined level, and said humidity sensing means being distally located from said grate within said drying space.

6. An apparatus for uniformly drying articles and for protecting said articles from damage, said apparatus comprising:

enclosure walls surrounding a drying space, said drying space being configured to hold said articles;

an air exchanger coupled to said enclosure walls, said air exchanger including:

a grate, having an inlet baffle portion and an outlet baffle portion, said grate being positioned to face said drying space, said inlet baffle portion being configured to direct air flow in a first direction, said outlet baffle portion being configured to direct air flow in a second direction, and said first and second directions being different from one another, a circulation chamber having an inlet and an outlet, said chamber inlet being coupled to said inlet baffle portion of said grate and said chamber outlet being coupled to said outlet baffle portion of said grate, and air propelling means coupled to said circulation chamber to move air from said inlet baffle portion of said grate to said outlet baffle portion of said grate; and a heater, coupled to one of said circulation chamber of said air exchanger and said enclosure.

7. An apparatus as claimed in claim 6 wherein a portion of said enclosure walls located proximate said inlet baffle portion of said grate is configured to include an exhaust port.

8. An apparatus as claimed in claim 7 additionally comprising second air propelling means coupled to said enclosure walls proximate said exhaust port, said second air propelling means being for urging humid air out from said drying space.

9. An apparatus as claimed in claim 8 additionally comprising humidity sensing means coupled to said second air propelling means, said humidity sensing means being configured to activate said second air propelling means when humidity within said drying space exceeds a predetermined level.

10. An apparatus as claimed in claim 6 wherein:

said grate has first and second opposing end sections separated by a central section;

said first and second end sections collectively serve as said outlet baffle portion of said grate; and said central section serves as said inlet baffle portion of said grate.

11. An apparatus as claimed in claim 10 wherein:

said first end section directs air flow in said first direction, wherein a component of said first direction generally extends toward said first end from a point centrally located on said grate;

said second end section directs air flow in a third direction, wherein a component of said third direction generally extends toward said second end from said point centrally located on said grate;

said central section directs air flow in said second direction, wherein a component of said second direction is generally the average of said first and third directions, said first end, second end, and central sections cooperating with said enclosure walls to circulate air within said drying space so that air tends to travel out from said grate along a path which resides near said enclosure walls and into said grate along a path which resides in a central portion of said drying space.

12. An apparatus as claimed in claim 6 additionally comprising a thermostat coupled to said heater, said thermostat being positioned within said air exchanger between said inlet baffle portion of said grate and said air propelling means.

13. An apparatus as claimed in claim 6 wherein said air exchanger is positioned proximate a bottom portion of said drying space and said grate faces generally upward.

14. An apparatus as claimed in claim 6 additionally comprising a rack positioned generally horizontal within said drying space, said rack being configured to permit air flow therethrough, to support said articles, and to keep said articles in a stationary position within said drying space.

15. An apparatus as claimed in claim 6 wherein said enclosure walls include a generally transparent wall so that said articles located in said drying space are observable from outside of said enclosure walls.

16. A method of drying shoes without causing damage to said shoes, said method comprising the steps of:

holding said shoes at a stationary position within an enclosure;

continually propelling air within said enclosure around said shoes until said shoes are substantially dry;

maintaining said propelled air at a predetermined temperature, said predetermined temperature being greater than ambient temperature outside of said enclosure;

recirculating a substantial portion of said propelled air so long as humidity of said propelled air is below a predetermined level, said recirculating step comprising the step of locating a grate in a bottom portion of said enclosure, said grate being configured to simultaneously expel said propelled air in a first direction while injecting said propelled air from a second direction, said first and second directions differing from one another so that said propelled air circulates within said enclosure; and exhausting said substantial portion of said propelled air out from said enclosure when humidity of said propelled air exceeds said predetermined level.

17. A method as claimed in claim 16 wherein said locating step includes the steps of:

centrally positioning said grate in said bottom portion of said enclosure; and configuring said grate so that air being expelled tends to travel upward away from said grate along walls of said enclosure and air being injected into said grate tends to travel downward to a central section of said enclosure.

18. A method as claimed in claim 17 additionally comprising the step of locating a humidity sensor in an upper portion of said enclosure to determine whether said humidity exceeds said predetermined level.

* * * * *